US007198206B2

(12) United States Patent
Soria et al.

(10) Patent No.: US 7,198,206 B2
(45) Date of Patent: Apr. 3, 2007

(54) COMPACT GASSING LANCE

(75) Inventors: F. Javier Soria, Northlake, IL (US); David B. Hutter, Orland Park, IL (US); Asim B. Siddiqui, Elgin, IL (US); John E. Sanfilippo, Barrington Hills, IL (US); James J. Sanfilippo, Barrington Hills, IL (US)

(73) Assignee: Clear Lam, Inc., Elk Grove Village, IL (US)

( * ) Notice: Subject to any disclaimer, the term of this patent is extended or adjusted under 35 U.S.C. 154(b) by 197 days.

(21) Appl. No.: 10/909,495

(22) Filed: Aug. 2, 2004

(65) Prior Publication Data

US 2006/0022068 A1 Feb. 2, 2006

(51) Int. Cl.
*B05B 15/06* (2006.01)
*B05B 1/14* (2006.01)
*A62C 31/02* (2006.01)

(52) U.S. Cl. ..... 239/532; 239/525; 239/589; 239/590; 239/590.3

(58) Field of Classification Search ..... 239/532, 239/525, 533.12, 589, 590, 590.3, 601, 11
See application file for complete search history.

(56) References Cited

U.S. PATENT DOCUMENTS

| | | | | |
|---|---|---|---|---|
| 2,145,941 A | | 2/1939 | Maxfield | |
| 2,160,367 A | | 5/1939 | Maxfield | |
| 3,708,952 A | | 1/1973 | Schulze et al. | |
| 3,789,888 A | | 2/1974 | James et al. | |
| 3,860,047 A | | 1/1975 | Finkelmeier et al. | |
| 3,861,116 A | | 1/1975 | Domke | |
| 3,889,933 A | | 6/1975 | Jaquay | |
| 3,942,301 A | | 3/1976 | Domke | |
| 3,980,238 A | * | 9/1976 | Adiletta | 239/590.3 |
| 4,150,793 A | * | 4/1979 | Russo | 239/532 |
| 4,253,860 A | * | 3/1981 | Hummel | 65/27 |
| 4,262,708 A | | 4/1981 | De Echeandia et al. | |
| 4,294,277 A | | 10/1981 | Szeliga | |
| 4,344,467 A | | 8/1982 | Lahde | |
| 4,448,011 A | | 5/1984 | Pohl | |
| 4,492,365 A | * | 1/1985 | Desaar | 266/220 |
| 4,641,486 A | | 2/1987 | Zannoli | |
| 4,658,566 A | | 4/1987 | Sanfilippo et al. | |
| 4,769,974 A | | 9/1988 | Davis | |
| 4,905,454 A | | 3/1990 | Sanfilippo et al. | |

(Continued)

FOREIGN PATENT DOCUMENTS

AU B-59122/94 3/1994

(Continued)

OTHER PUBLICATIONS

U.S. Appl. No. 10/689,780, filed Oct. 22, 2003, John E. Sanfilippo.

*Primary Examiner*—Davis Hwu
(74) *Attorney, Agent, or Firm*—Cardinal Law Group

(57) ABSTRACT

A compact gassing lance including tubing having a tubing plenum and a distribution opening; a supply line operably connected to supply gas to the tubing plenum; and a screen attached to the tubing over the distribution opening and forming a screen plenum; wherein the screen plenum receives directional gas flow from the distribution opening and laminarizes the directional gas flow.

10 Claims, 6 Drawing Sheets

U.S. PATENT DOCUMENTS

| | | | | | |
|---|---|---|---|---|---|
| 4,936,943 | A | | 6/1990 | Kubis et al. | |
| 4,964,259 | A | | 10/1990 | Ylvisaker | |
| 5,001,878 | A | | 3/1991 | Sanfilippo et al. | |
| 5,069,020 | A | | 12/1991 | Sanfilippo et al. | |
| 5,109,654 | A | | 5/1992 | Suga | |
| 5,170,943 | A | * | 12/1992 | Artzberger | 239/532 |
| 5,228,269 | A | | 7/1993 | Sanfilippo et al. | |
| 5,417,255 | A | | 5/1995 | Sanfilippo et al. | |
| 5,535,836 | A | * | 7/1996 | Cagianut et al. | 175/213 |
| 5,617,705 | A | | 4/1997 | Sanfilippo et al. | |
| 5,669,419 | A | | 9/1997 | Haas | |
| 5,793,009 | A | * | 8/1998 | Offer | 219/75 |
| 5,816,024 | A | | 10/1998 | Sanfilippo et al. | |
| 5,822,951 | A | | 10/1998 | Rosik | |
| 5,857,485 | A | | 1/1999 | Perkins et al. | |
| 5,911,249 | A | | 6/1999 | Sanfilippo et al. | |
| 5,916,110 | A | | 6/1999 | Sanfilippo et al. | |
| 5,918,616 | A | | 7/1999 | Sanfilippo et al. | |
| 5,961,000 | A | | 10/1999 | Sanfilippo et al. | |
| 5,981,897 | A | * | 11/1999 | Offer et al. | 219/75 |
| 6,032,438 | A | | 3/2000 | Sanfilippo et al. | |
| 6,119,438 | A | | 9/2000 | Bacon et al. | |
| 6,202,388 | B1 | | 3/2001 | Sanfilippo et al. | |
| 6,221,411 | B1 | | 4/2001 | Sanfilippo et al. | |
| 6,273,129 | B1 | | 8/2001 | Chavand et al. | |
| 6,343,459 | B1 | | 2/2002 | Seaward et al. | |
| 6,405,745 | B1 | | 6/2002 | Kar et al. | |
| 6,450,190 | B2 | | 9/2002 | Ohmi et al. | |
| 6,735,928 | B2 | | 5/2004 | Kondo et al. | |
| 2001/0005974 | A1 | | 7/2001 | Kondo et al. | |
| 2004/0084087 | A1 | | 5/2004 | Sanfilippo et al. | |

FOREIGN PATENT DOCUMENTS

| | | |
|---|---|---|
| AU | B-26403/95 | 5/1995 |
| AU | B-54743/96 | 6/1996 |
| AU | 199717896 | 11/1997 |
| AU | 199720087 | 11/1997 |
| CA | 2190461 | 11/1995 |
| CA | 2204466 | 5/1997 |
| EP | 0 758 977 | 5/1995 |

* cited by examiner

COMPACT GASSING LANCE

FIELD OF THE INVENTION

The invention relates to apparatus for exposing product to a controlled environment, and more particularly to a compact gassing lance for delivering gasses and mixtures.

BACKGROUND OF THE INVENTION

Various products, including food products, semiconductor products, medical products, and any other products having an adverse reaction to air, are packaged in a controlled environment. Various attempts have been made to efficiently package these products in controlled environments using vacuum and/or controlled environments.

Various food products, including bakery goods, meats, fruits, and vegetables, are packaged under atmospheric conditions. Many of these products are presented in supermarkets, for example, in bags, cartons, or cardboard containers with a plastic or cellophane wrap covering the product.

One problem with this type of packaging is that the goods have a minimum limited shelf life, which for many products is only several days to a week. With bakery goods for example, mold may begin to grow after a few days under atmospheric conditions. Such products obviously cannot be sold or consumed and must be discarded. Another problem arises with respect to many fruits and vegetables, which continue to ripen and continue their metabolic process under atmospheric conditions. For example, within a few days a banana can become overripe and undesirable to the consumer.

Air in-leakage is a problem in weighing and timing machines, which automate the packaging process. The space available for gassing operations is often limited in machines such as combination weighers, which employ weighing buckets and timing hoppers to meter the product and fill packages. The measuring and packaging components move near each other at great speed to be able to fill hundreds of packages a minute. The product also moves through the machines in great volumes at great speed. Such machines have limited clearance for additional components and must be easy to disassemble for cleaning and maintenance. There is little space to deliver gasses and mixtures at the point of need to establish a controlled environment.

It would be desirable to have a compact gassing lance that overcomes the above disadvantages.

SUMMARY OF THE INVENTION

The present invention provides a compact gassing lance including tubing having a tubing plenum and a distribution opening; a supply line operably connected to supply gas to the tubing plenum; and a screen attached to the tubing over the distribution opening and forming a screen plenum; wherein the screen plenum receives directional gas flow from the distribution opening and laminarizes the directional gas flow.

Another aspect of the invention provides a system for compact gassing including means for generating a directional flow, means for providing gas to the generating means, and means for laminarizing the directional flow.

Yet another aspect of the invention provides a method for compact gassing including supplying gas near a machine wall as supplied gas, directing the supplied gas at an angle from the machine wall as directed gas, and laminarizing the directed gas.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

DETAILED DESCRIPTION OF PRESENTLY PREFERRED EMBODIMENTS

Figure 1:
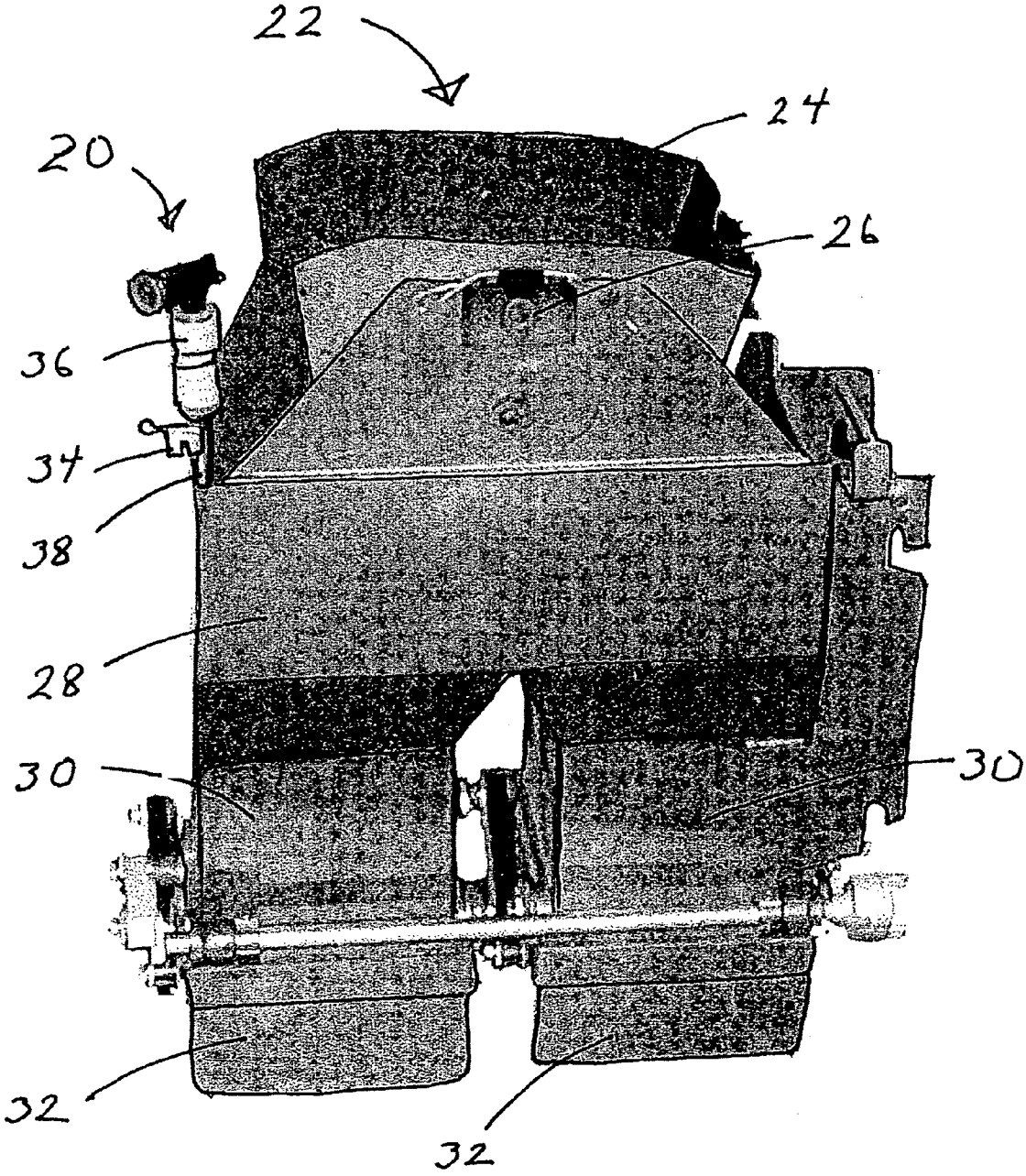
FIG. 1 is an illustrative operating environment for a compact gassing lance made in accordance with the present invention.

FIG. 1 is an illustrative operating environment for a compact gassing lance made in accordance with the present invention. In this example, the compact gassing lance 20 is used with a filler device 22. The compact gassing lance 20 provides gas within the limited clearances of the filler device 22 to reduce the air included with the product passing through the filler device 22.

The filler device 22 receives, weighs, and dispenses a product. The product, such as a food product, is received at the swinging diverter 24. The swinging diverter 24 swings about pivot 26 within common bin 28 to deliver the product alternately to one of the two weighing bins 30. The jaws 32 are closed as the product is weighed within the weighing bin 30 and open after the product is weighed to dispense the product to a package. The filler device 22 typically dispenses hundreds of product portions per minute.

The compact gassing lance 20 in this example is suspended from the edge of the common bin 28 by an attachment clip 34. A gas supply (not shown) attached to the gas connector 36 provides gas through the supply line 38 to the lance head (not shown). The lance head is located near the junction of the common bin 28 and the weighing bin 30, where the gas is needed. The supply line 38 is sized to avoid the swinging action of the swinging diverter 24. All components of the compact gassing lance 20 are sized and routed to fit the filler device 22. A number of compact gassing lances can be used with a single filler device. For example, one compact gassing lance can be provided for each of the weighing bins 30. The compact gassing lance 20 is only attached to the filler device 22 at the attachment clip 34, so the compact gassing lance 20 can be easily removed for cleaning of the filler device 22 and cleaning of the compact gassing lance 20 itself.

Those skilled in the art will appreciate that the compact gassing lance 20 can be used with any device or machine where a gas supply is needed and clearances are limited. The compact gassing lance 20 can be used with combination weighers, weighing buckets, timing hoppers, or any other product handling system. The compact gassing lance 20 need only be located near a machine wall to provide a blanket flow of gas, which follows along the machine wall. The blanket flow can limit air in-leakage to the product to a few parts per million.

Figure 2:
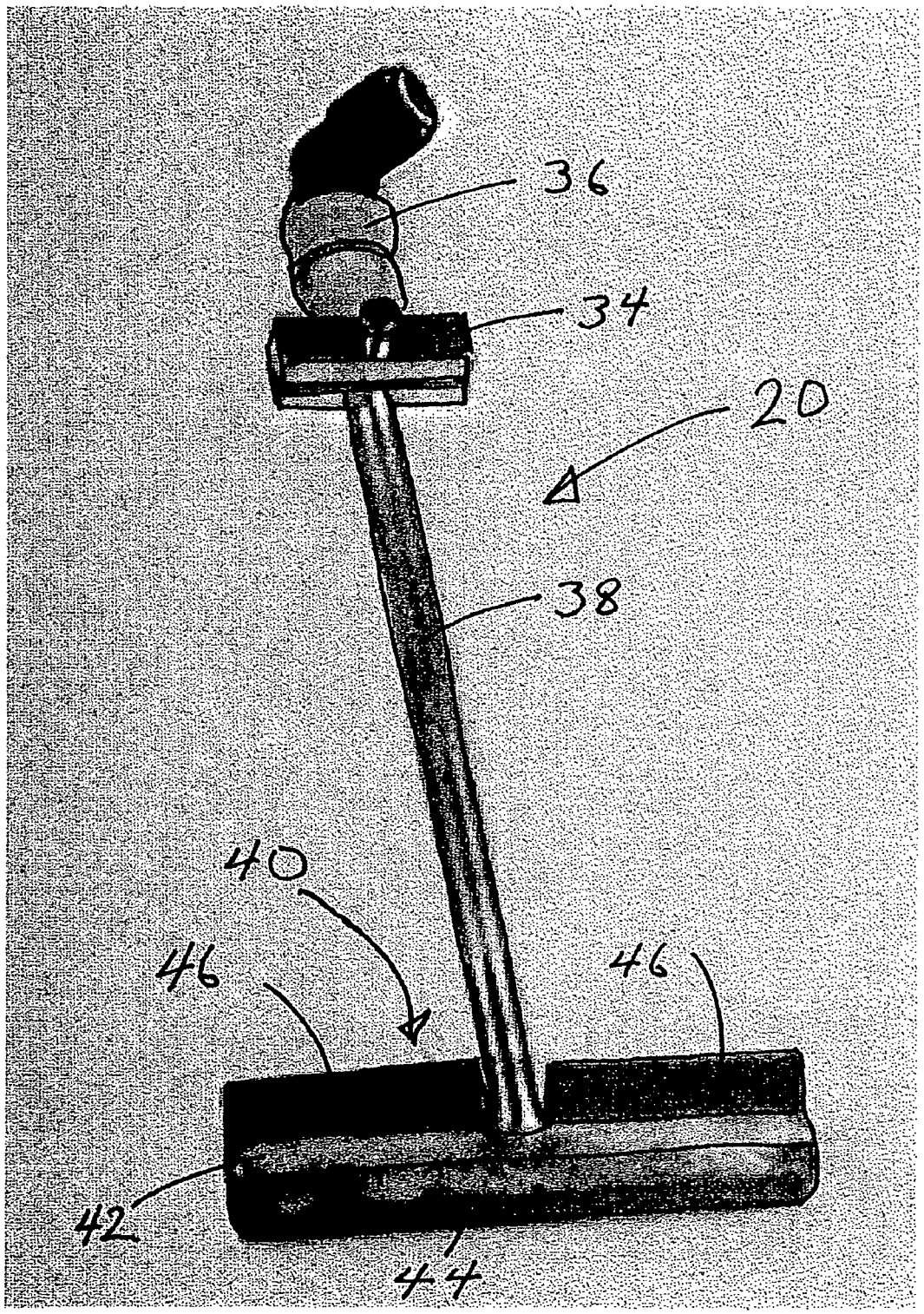
FIGS. 2 & 3 are general and detailed back views, respectively, of a compact gassing lance made in accordance with the present invention.
Figure 3:
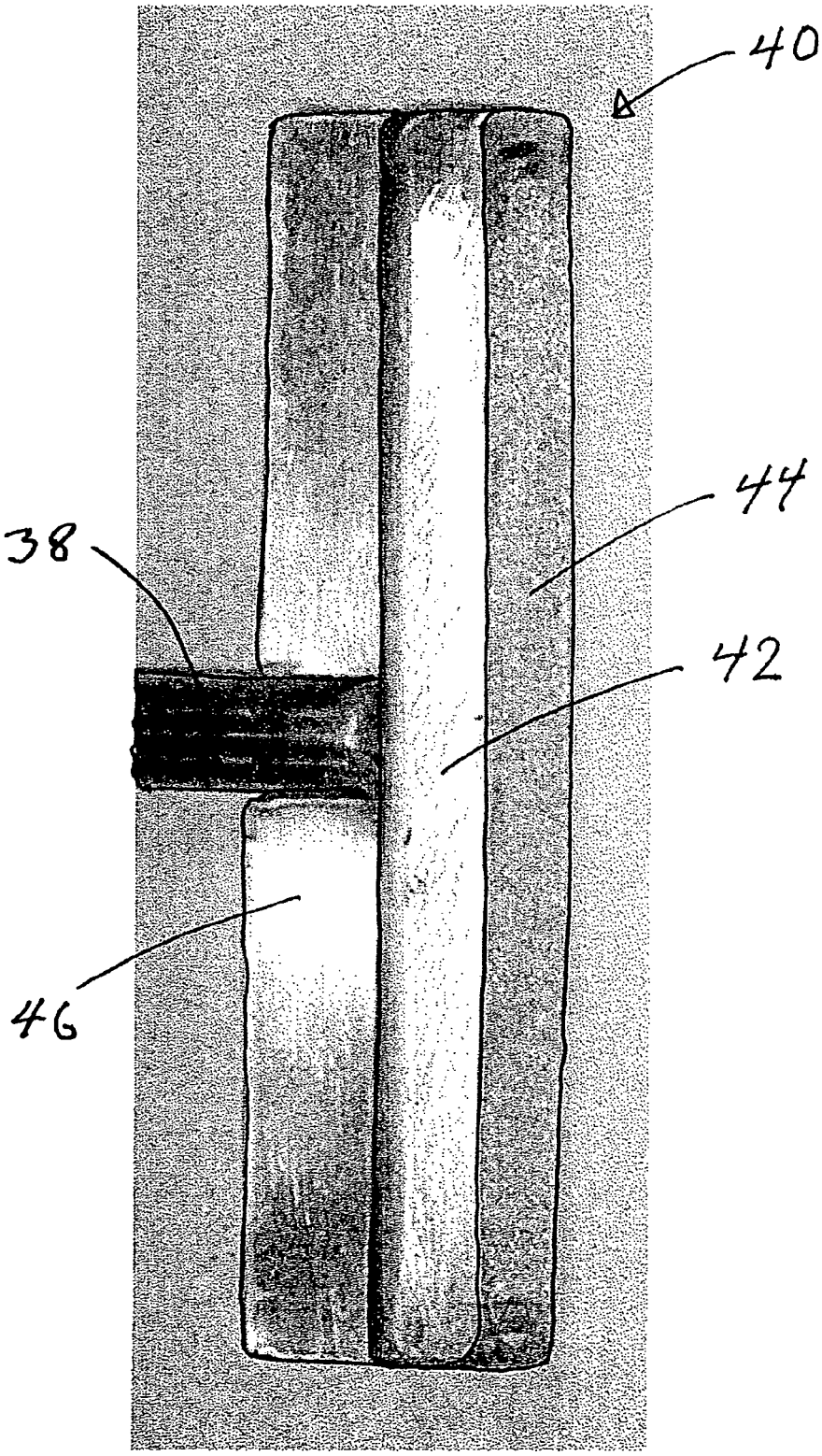

FIGS. 2 & 3, in which like elements share like reference numbers with each other and with FIG. 1, are general and detailed back views, respectively, of a compact gassing lance made in accordance with the present invention. The compact gassing lance 20 includes a gas connector 36, an attachment clip 34, a supply line 38, and a lance head 40. The lance head 40 includes tubing 42 and screen 44. In this embodiment, the lance head 40 also includes a flow deflector 46.

During operation, the lance head 40 of the compact gassing lance 20 is disposed to supply gas to a region in which gas is needed, such as a region of air in-leakage. In one embodiment, an inert gas is introduced to reduce the presence of air included in a package with a product. The gas reaches the lance head 40 through the supply line 38 connected to the gas connector 36. The gas enters the tubing 42, passes through a distribution opening (not shown) in the tubing 42, and is laminarized in passing through the screen 44. Typically, the ends of the lance head 40 are plugged to confine the gas flow from the tubing 42 to the distribution opening. The flow deflector 46 directs product away from the lance head 40. The attachment clip 34 provides a mechanism for attaching the compact gassing lance 20 to the device with which it is being used at the point in which the gas is needed.

The supply line 38 and gas connector can be any suitable hardware for connecting the lance head 40 to a gas supply system and for locating the lance head 40 in the desired position to dispense the gas. As used herein, gas includes any gas or mixture used to provide a controlled environment around a product, such as inert gas, carbon dioxide, oxygen, nitrogen, combinations of gases, and combinations of gases with aromas, mists, and/or moisture. In one embodiment, the supply line 38 is a rigid pipe, such as a stainless steel pipe. One exemplary application as illustrated in FIG. 2 uses a 304 stainless steel pipe having an outer diameter of ⅜ inch and an inner diameter of ¼ inch for the supply line 38. In an alternate embodiment, the supply line 38 is a flexible tube, such as a plastic tube. The attachment clip 34 can be any suitable material and configuration required to maintain the compact gassing lance 20 in position near the machine wall of the associated machinery, such as the machine wall of a filler device. One exemplary application as illustrated in FIG. 2 uses a 304 stainless steel U-shaped attachment clip and a tightening bolt.

Figure 4:
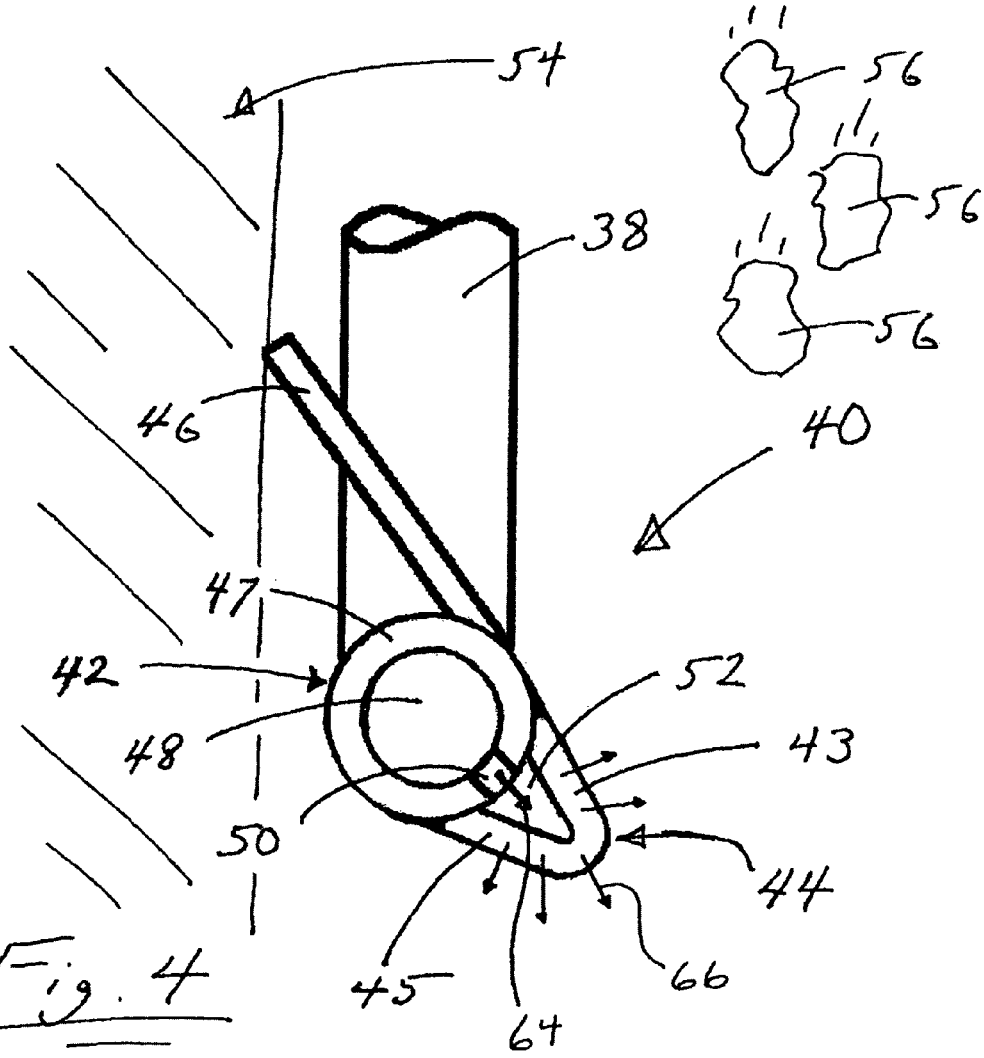
FIGS. 4 & 5 are schematic diagrams of a lance head cross section and tubing, respectively, of a compact gassing lance made in accordance with the present invention.
Figure 5:
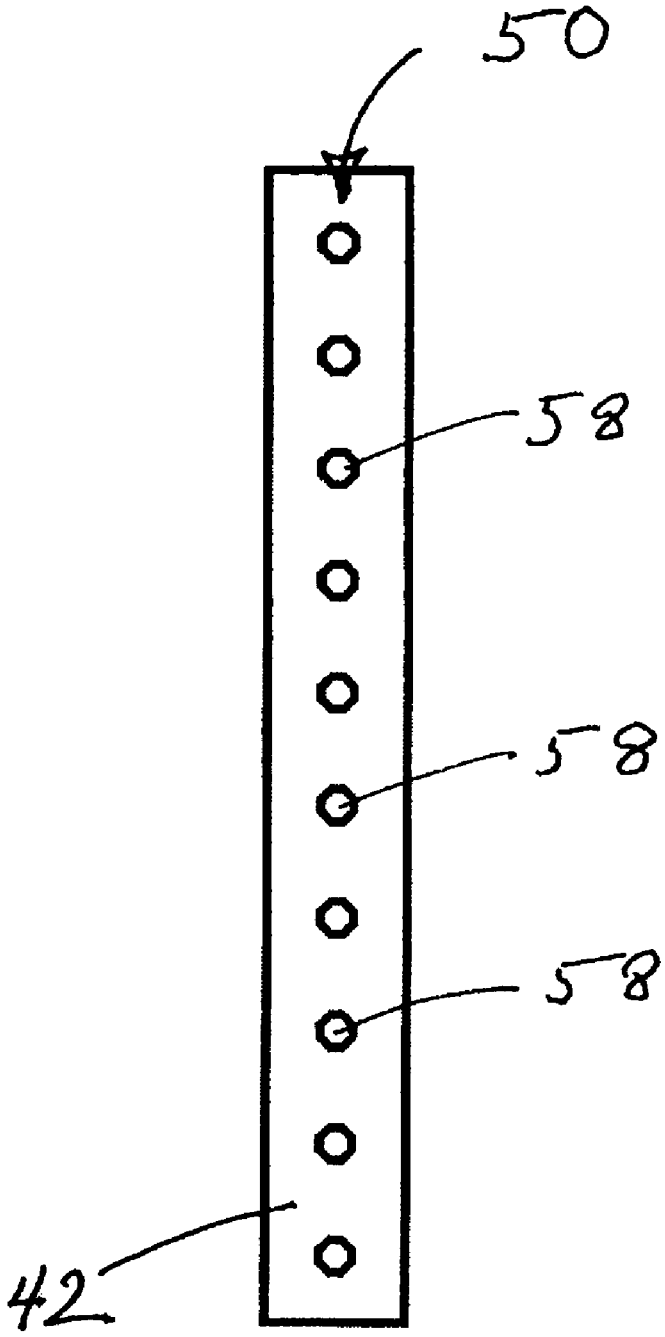

FIGS. 4 & 5, in which like elements share like reference numbers with each other and with FIGS. 2 & 3, are schematic diagrams of a lance head cross section and tubing, respectively, of a compact gassing lance made in accordance with the present invention. The lance head 40 receives gas from a supply line and delivers a laminarized gas flow 66. The lance head 40 is illustrated near machine wall 54 by which product 56 is passing.

The lance head 40 includes tubing 42 and a screen 44. The wall 47 of the tubing 42 forms a tubing plenum 48. A distribution opening 50 is formed in the wall 47. The screen 44 is attached to the tubing 42 over the distribution opening 50, forming a screen plenum 52 between the tubing 42 and the screen 44. The screen 44 typically has an upper screen portion 43 upstream in the product flow and a lower screen portion 45 downstream of the product flow. Gas from the supply line 38 enters the tubing plenum 48, passes through the distribution opening 50 into the screen plenum 52 as directional gas flow 64, and passes through the screen 44 to form laminarized gas flow 66. The directional gas flow 64 is indicated by the arrow from the distribution opening 50 and the laminarized gas flow 66 is indicated by the arrows from the screen 44.

The screen plenum 52 can have different cross sections, depending on the desired application. For example, the screen plenum cross section shape can be semi-circular, square, rectangular, triangular, ovoid, ellipsoid, polygonal, or the like.

The distribution opening 50 can be at any angle relative to the product flow to deliver the directional gas flow 64 in the desired direction. This allows the laminarized gas flow 66 to be directed concurrent, perpendicular, or counter to the direction of product flow. In one embodiment, the distribution opening direction, i.e., the direction from the center of the tubing plenum 48 through the center of the distribution opening 50, is between 0 and 180 degrees of the product flow direction. In an alternate embodiment, the distribution opening direction is between 0 and 90 degrees of the product flow direction, and is typically about 45 degrees.

Referring to FIG. 5, the distribution opening 50 can have different configurations depending on the directional gas flow 64 desired. The distribution opening 50 includes a number of holes 58 of uniform size arranged in a line along one side of the tubing 42. In this exemplary embodiment, the holes 58 are about 1/16 of an inch in diameter on ½ inch centers for the tubing 42 having an outer diameter of ⅜ inch and an inner diameter of ¼ inch. Any distribution opening 50 configuration which communicates between the tubing plenum 48 and the screen plenum 52 can be used. In alternate embodiments, the distribution opening 50 can have different configurations, such as a single slot, holes in various patterns (in addition to holes in a line), holes of various sizes, and combinations thereof. Typically, the distribution opening 50 is located on one side of the tubing 42.

The tubing 42 can be made of any material compatible with the gas and the product. Typical materials for the tubing 42 include non-ferrous metal or stainless steel. In one embodiment, the tubing 42 is a 304 stainless steel pipe having an outer diameter of ⅜ inch and an inner diameter of ¼ inch. In one embodiment, the tubing 42 has an outer diameter between ¼ and 1 inch. The tubing 42 can have different diameters and cross sections, depending on the desired application. For example, the tubing cross section shape can be semi-circular, square, rectangular, triangular, ovoid, ellipsoid, polygonal, or the like.

The screen 44 can be made of any material compatible with the gas and the product. Typical materials for the screen 44 include non-ferrous metal or stainless steel. The screen 44 is porous and offers a small flow resistance to convert the directional gas flow 64 to the laminarized gas flow 66. In one embodiment, the screen 44 is a stainless steel, five-ply wire screen having a mesh size of between about 10–100 microns. In one embodiment, a mesh size of 75 microns is used. Those skilled in the art will appreciate that different numbers of plies and mesh sizes can be used for different applications. In one embodiment, the screen 44 has between 2 and 10 plies. The screen 44 can be attached to the tubing 42 by welding, braising, or soldering. The lance head 40 can be ground, shaped, and polished to a final shape and surface finish as desired. The ends of the tubing 42 can be sealed with a welded plug, by welding alone, or by crimping.

In operation, gas is supplied near a machine wall as supplied gas, which is directed at an angle from the machine wall as directed gas, which is laminarized. The laminarized gas typically has a low velocity allowing it to form a blanket flow along the machine wall, preventing air in-leakage to the product flow. The lower screen 45 is away from the product flow, which keeps it clean, unobstructed, and available to laminarize the directional gas. Those skilled in the art will appreciate that the directed gas can be directed in different angles relative to the product flow direction to achieve the desired results.

Figure 6:
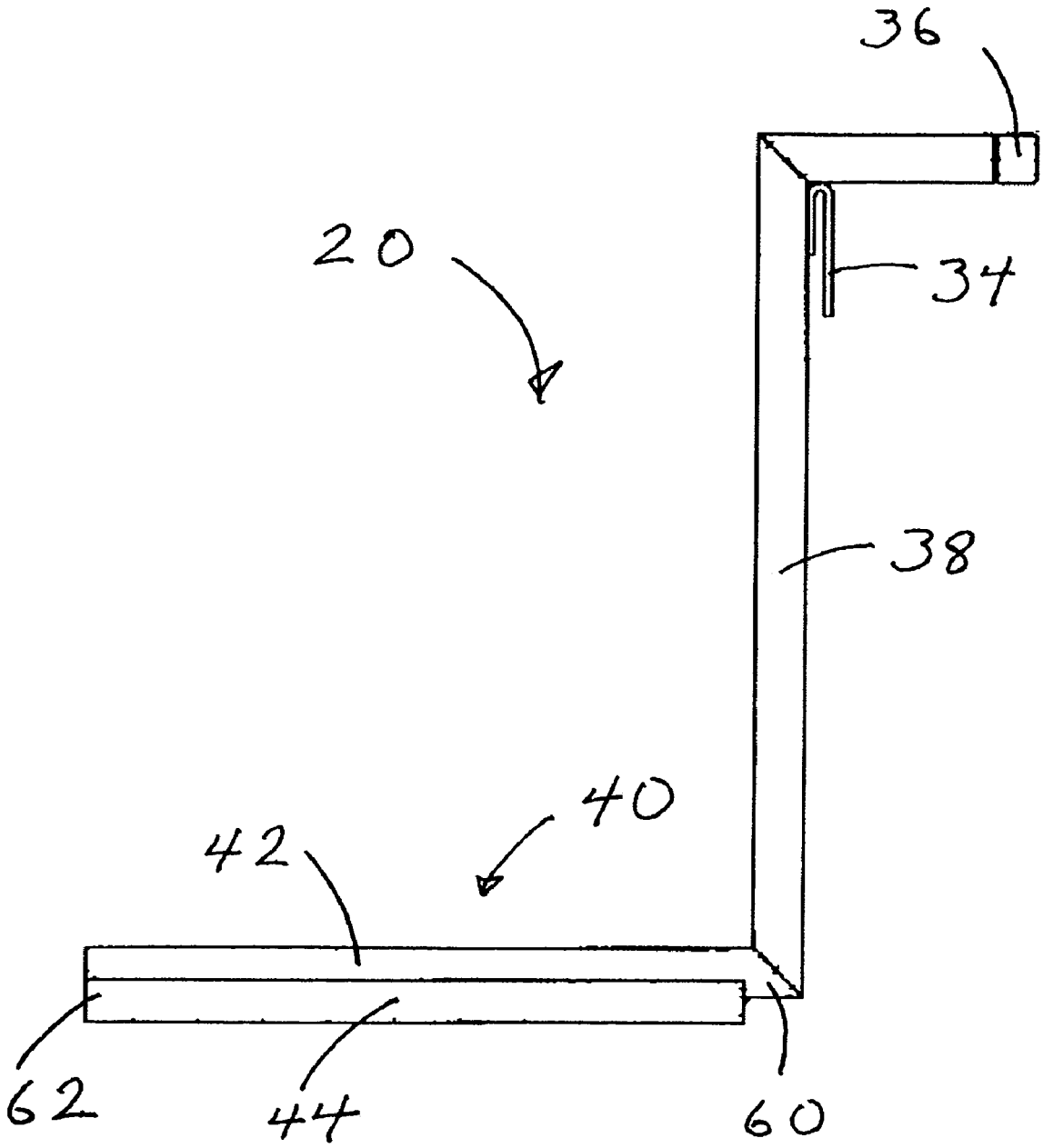
FIG. 6 is a schematic diagram of another embodiment of a compact gassing lance made in accordance with the present invention.

FIG. 6, in which like elements share like reference numbers with FIGS. 2 & 3, is a schematic diagram of another embodiment of a compact gassing lance made in accordance with the present invention. In this embodiment, the supply line 38 provides gas to first end of the lance head 40, rather than providing the gas in the middle of the lance head 40 as illustrated in FIG. 2. In the embodiment of FIG. 6, the second end 62 of the lance head 40 is plugged. The rigid supply line 38 can be configured in a series of right angle bends and/or curves in three dimensions to support the lance head 40 and deliver the gas to the desired location.

While the embodiments of the invention disclosed herein are presently considered to be preferred, various changes and modifications can be made without departing from the scope of the invention. The scope of the invention is indicated in the appended claims, and all changes that come within the meaning and range of equivalents are intended to be embraced therein.

We claim:

1. A compact gassing lance, the lance comprising:

tubing, the tubing having a tubing plenum and a distribution opening wherein the distribution opening direction is 45 degrees from a product flow direction;

a supply line, the supply line being operably connected to supply gas to the tubing plenum; and a lance head surrounding at least a portion of the tubing including the distribution opening and the lance head including a flow deflector and a screen, the screen being attached to the lance head over the distribution opening and forming a screen plenum;

wherein the screen plenum receives directional gas flow from the distribution opening and laminarizes the directional gas flow.

2. The lance of claim 1 wherein the tubing cross section shape is selected from the group consisting of semi-circular, square, rectangular, triangular, ovoid, ellipsoid, and polygonal.

3. The lance of claim 1 wherein the tubing is made of a material selected from the group consisting of non-ferrous metal and stainless steel.

4. The lance of claim 1 wherein the tubing has an outer diameter between ¼ and 1 inch.

5. The lance of claim 1 wherein the distribution opening comprises a plurality of holes.

6. The lance of claim 1 wherein the screen comprises a multi-ply wire screen.

7. The lance of claim 1 wherein the screen has between 2 and 10 plies.

8. The lance of claim 1 wherein the screen has a mesh size between 10 and 100 microns.

9. The lance of claim 1 wherein the screen is made of a material selected from the group consisting of non-ferrous metal and stainless steel.

10. The lance of claim 1 wherein the screen plenum cross section shape is selected from the group consisting of semi-circular, square, rectangular, triangular, ovoid, ellipsoid, and polygonal.

* * * * *